United States Patent [19]

Kern et al.

[11] 4,020,809

[45] May 3, 1977

[54] EXHAUST GAS RECIRCULATION SYSTEM FOR A DIESEL ENGINE

[75] Inventors: Richard A. Kern, Pekin; Carl L. McClung, Metamora; James R. Turner, Chillicothe, all of Ill.

[73] Assignee: Caterpillar Tractor Co., Peoria, Ill.

[22] Filed: June 2, 1975

[21] Appl. No.: 583,230

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 1,679,521 | 8/1928 | Good | 123/119 A |
| 2,354,179 | 7/1944 | Blanc | 123/119 A |
| 2,456,213 | 12/1948 | Pelc | 123/119 A |
| 2,700,967 | 2/1955 | Maker | 123/119 A |
| 3,135,253 | 6/1964 | Muhlberg | 123/119 A |
| 3,915,134 | 10/1975 | Young | 123/119 A |
| 3,916,857 | 11/1975 | Naito | 123/119 A |

*Primary Examiner*—Wendell E. Burns
*Attorney, Agent, or Firm*—Oscar G. Pence

[57] ABSTRACT

An exhaust gas recirculation system is provided for reducing the content of oxides of nitrogen in the exhaust of a diesel engine. The system is effective in recirculating variable amounts of exhaust gas back through the engine in relation to engine load by being operatively controlled in response to predetermined settings of the engine's fuel supply system.

6 Claims, 4 Drawing Figures

EXHAUST GAS RECIRCULATION SYSTEM FOR A DIESEL ENGINE

BACKGROUND OF THE INVENTION

The emission of oxides of nitrogen ($NO_x$) from the exhaust of internal combustion engines is a direct function of the combustion temperatures of such engines and does not become particularly objectionable until such combusition temperatures exceed about 2400°F. However, such temperatures frequently increase to about 3500°F under certain operating conditions. It is known that by recirculating a certain percentage of the exhaust gas back through the engine, enough dilution can be achieved to reduce the combustion temperatures and thus decrease $NO_x$ emissions to an acceptable level.

Numerous systems have been developed for recycling the exhaust gas through spark ignition engines. However, such systems untilize the vacuum created by the restriction of the intake air necessary to obtain the proper air-to-fuel mixture in such spark ignition engines.

Compression ignition or diesel engines, on the other hand, do not restrict intake air, and thus do not have the required vacuum necessary to regulate exhaust gas recirculation. Consequently, the apparatus typically used on spark ignition engines are not particularly applicable for such diesel engines.

OBJECTS

Accordingly, an object of this invention is to provide an exhaust gas recirculation system for a diesel engine which system is effective in reducing the emission of oxides of nitrogen from the exhaust of such engine during operation.

Another object of this invention is to provide such system which selectively varies the percentage of exhaust gas recirculation in response to engine load so that the emissions remain below acceptable levels during various operating conditions of the engine.

Another object of this invention is to provide an exhaust gas recirculation system which is responsive to the amount of fuel being supplied to the engine by its fuel system, rather than to intake air vacuum, to provide more precise control and uniform operation.

DESCRIPTION OF THE PREFERRED EMBODIMENT

Figure 1:
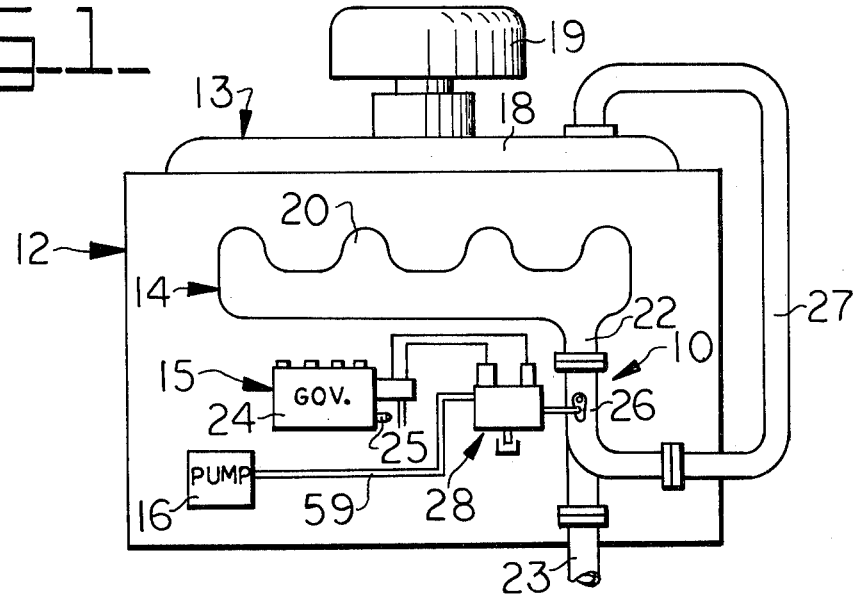
FIG. 1 is an overall side elevational view of an exhaust gas recirculation system embodying the principles of the present invention for use with a diesel engine, shown schematically.

Referring more particularly to the drawings, an exhaust gas recirculation system embodying the principles of the present invention is generally indicated at 10 for use in association with an internal combustion engine of the compression ignition or diesel type generally indicated by the reference numeral 12 which engine is operable within a predetermined load range. Such diesel engine generally includes various component systems, such as an air intake system 13, an exhaust system 14, and a fuel system 15. The engine is also provided with an engine oil pump 16 for lubrication purposes.

The air intake system 13 has an air intake manifold 18 and an air cleaner 19 for admitting air into the engine in the usual manner. The exhaust system includes an exhaust manifold 20 for discharging exhaust gases therefrom. The exhaust manifold has an outlet 22 to which an exhaust pipe 23 is normally connected for conducting the exhaust gases to atmosphere.

The fuel system 15 includes an engine governor and fuel pump assembly 24. Such assembly, as those skilled in the art will appreciate, has an infinite number of fuel suppply settings within a range corresponding to the engine load range and is automatically positionable in response to engine load to a particular one of such settings so as to supply the proper amount of fuel to the engine to meet the load. The assembly also includes mechanism, such as schematically shown by a rod 25 protruding from one end thereof for illustrative purposes, which moves in direct relation to changes in its fuel supply settings.

The exhaust gas recirculation system 10, as will be hereinafter more fully described; generally includes valve mechanism 26 disposed between the outlet 22 of the exhaust manifold 20 and the exhaust pipe 23, a return pipe 27 interconnected between the valve mechanism and the intake manifold 18, and control mechanism 28 operative in response to the governor fuel setting so as to selectively actuate the valve mechanism 26 for returning certain percentages of the exhaust gases to the engine during various operating conditions.

Figure 2:
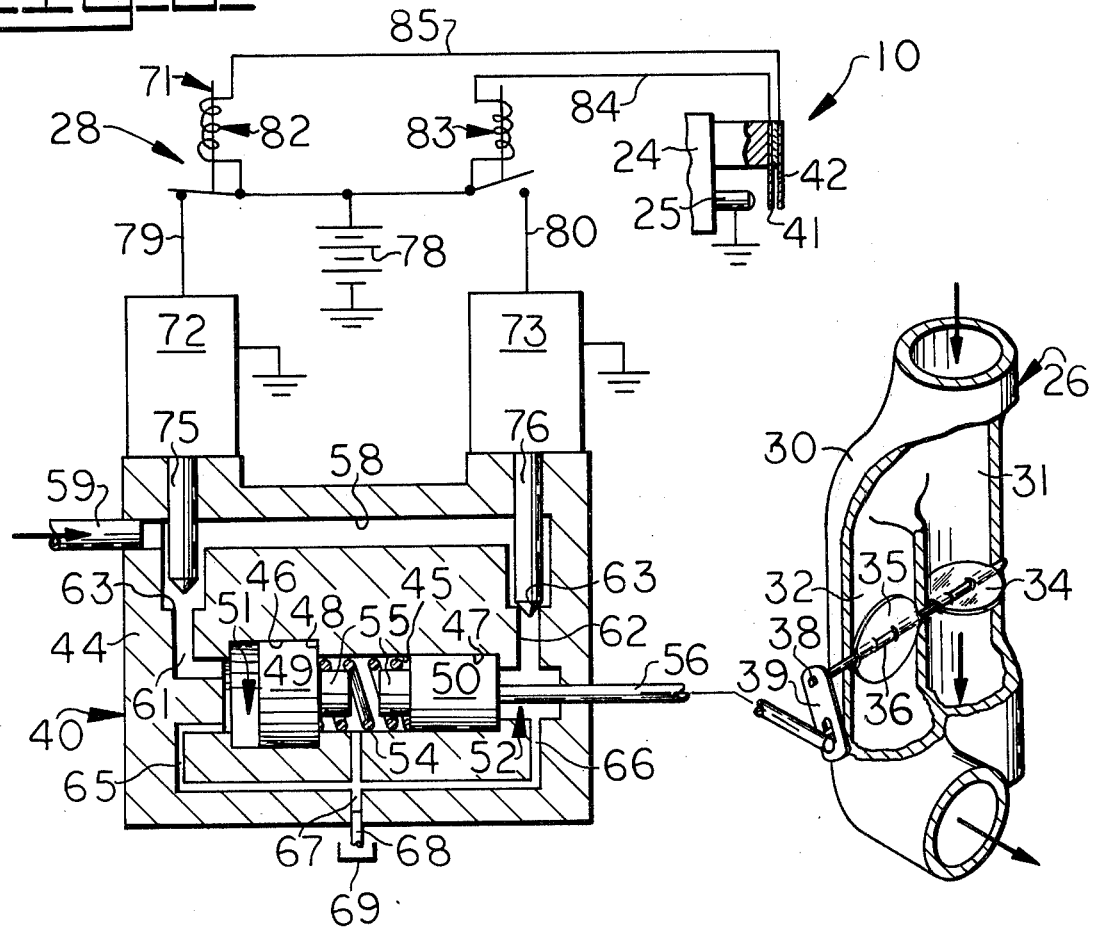
FIGS. 2 through 4 generally schematically illustrate the apparatus of the present exhaust gas recirculation system in its various operating positions with portions thereof broken away and shown in cross section.

As best shown in FIG. 2, the valve mechanism 26 includes a dual outlet manifold 30 having an exhaust passage 31 for communicating exhaust gas form the exhaust manifold to the exhaust pipe 23 and a separate return passage 32 for communicating exhaust gas to the return pipe 27. The valve mechanism also includes a pair of butterfly-type valves 34 and 35 which are individually disposed within the exhaust passage 31 and the return passage 32, respectively. The butterfly valves are mounted in a predetermined fixed angular relation relative to one another on a common shaft 36. Such shaft is pivotally disposed in transverse extending relation through the passages 31 and 32. The shaft is provided with an end 38 protruding from the manifold 30. A lever 39 is secured to such end for purposes hereinafter explained.

The control mechanism 28 includes motor means, such as a double piston hydraulic actuator 40 and sensing means, such as a pair of spring switches 41 and 42. The hydraulic actuator includes a housing 44 having a stepped bore 45 providing a large diameter end portion 46 and an opposite small diamter end portion 47 therein and defining a shoulder 48 therebetween. A large piston 49 and a small piston 50 are slidably disposed within their respective large and small diameter end portions of the stepped bore and define therewith a pair of fluid chambers 51 and 52 at the opposite ends of the bore. The pistons are normally urged outwardly away from each other by a spring 54. Each of the pistons is provided with one of a pair of engageable reduced diamter stop members 55 for positioning purposes. The small piston 50 also has a control rod 56 connected thereto and extending from the housing 44. The free end of the rod is pivotally mounted to the lever 39 for rotation of the valves 34 and 35 in a manner hereinafter more fully described.

The housing 44 also includes an inlet passage 58 for admitting fluid from the oil pump 16 through a conduit 59. a pair of branch passages 61 and 62 individually communicate fluid from the inlet passage to the fluid chambers 51 and 52, respectively. Each passage is provided with a plunger seat 63.

The housing also has a pair of restricted drain passages 65 and 66 for relieving fluid pressure from each of the chambers 51 and 52 and an intermediate drain passage 67 for relieving pressure from between the pistons due to leakage thereby. Such passages are connected to a conduit 68 for communicating such fluid to a reservoir 69, such as the engine's crankcase.

The control mechanism 28 includes an electrical control circuit 71 for selectively actuating the hydraulic actuator 40 in response to the closing of the spring switches 41 and 42. Such circuit includes a pair of spring biased solenoids 72 and 73 which have their respective plungers 75 and 76 normally urged against the seats 63 of the branch passages 61 and 62, respectively, for blocking the communication of fluid to chambers 51 and 52. The solenoids are connected in parallel to a source of electrical energy, such as a battery 78, by way of leads 79 and 80. A normally closed relay switch 82 is disposed in lead 79, whereas a normally open relay switch 83 is disposed in lead 80. Each relay switch is connected to the battery and to a respective one of the spring switches 41 and 42, by leads 84 and 85 respectively.

OPERATION

While the operation of the present invention is believed to be clearly apparent from the present invention is believed to be clearly apparent from the foregoing description, further amplification will be made in the following brief summary of such operation. When the diesel engine 12 is operating at no load, the movable rod 25 of the governor and fuel pump assembly 24 will be disposed in its least extended position, as shown in FIG. 2. The spring switches 41 and 42 are mounted in predetermined spaced relation relative to each other and to the rod so as to be out of contact therewith so that the circuit to each of the relay switches 82 and 83 is open. Thus, the relay switch 82 will be in its normally closed position to energize its solenoid 72 and relay switch 83 will be in its normally open position so that its solenoid 73 is de-energized. As a result, the plunger 75 of solenoid 72 will be retracted to permit the communication of fluid pressure from the pump 16 to the chamber 51, so as to shift the large piston 49 rightwardly as viewed in the drawing against the shoulder 48. As the pressure to the opposite chamber 52 is blocked by the plunger 76 of the solenoid 73, the spring 54 is effective in shifting the small piston 50 to its extreme right position against the end of the small diameter end 47 of the bore. Thus, the control rod 56 will be in its rightwardmost extended position to rotate the butterfly valves 34 and 35 to a first or maximum exhaust gas recirculation position.

At such first position, the valve mechanism 26 is effective in providing approximately 30 to 40 percent exhaust gas recirculation through the engine 12. This is accomplished by the relative angular positions of the butterfly valves 34 and 35 within their respective passages 31 and 32. As is readily shown in FIG. 2, the butterfly valve 34 is generally transversely disposed across the exhaust passage 31 in a maximum flow restricting position, whereas the butterfly valve 35 is disposed at a fully open position in the return passage 32. It should be noted that the percentages of exhaust gas recirculation used herein are indicative of the percentage of fresh air which is displaced by exhaust gas.

Figure 3:
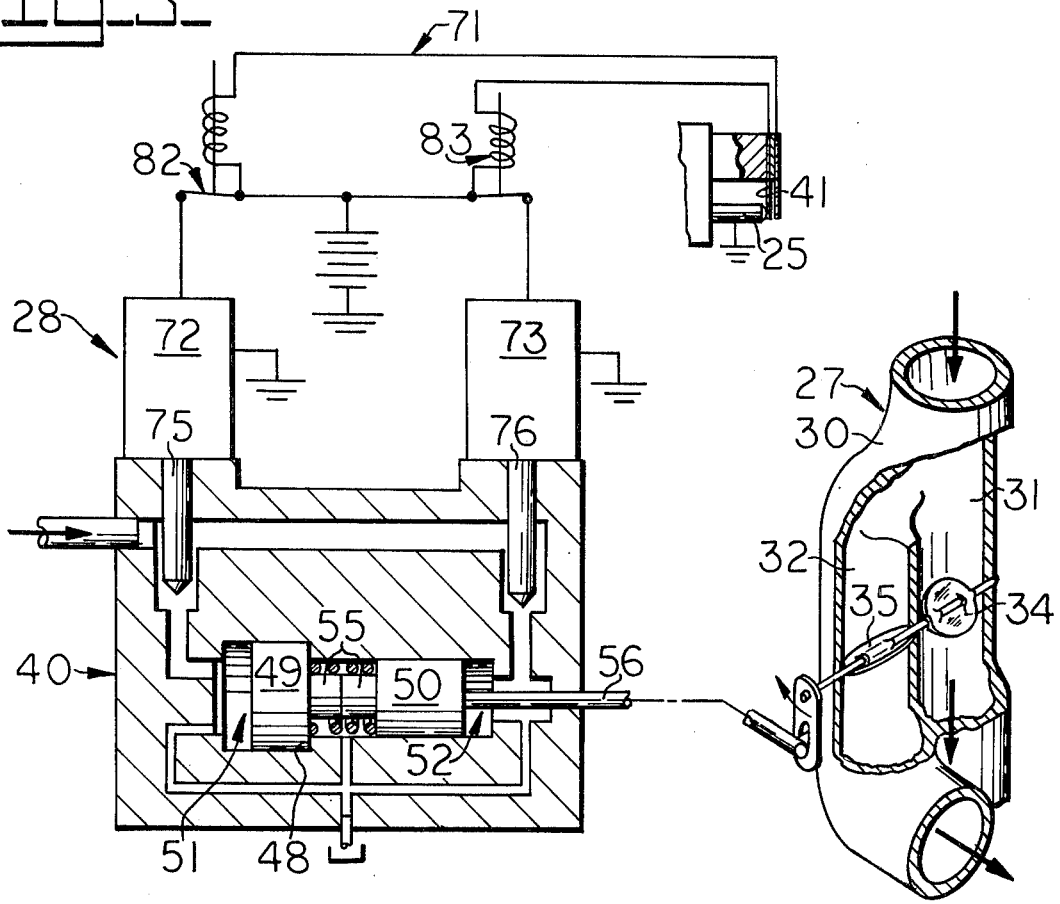

When the engine 12 reaches approximately 55 percent of its rated load, the rod 25 will move out so as to contact the first spring switch 41, as shown in FIG. 3. This is effective in completing the circuit to the normally open relay switch 83, causing it to close, thus energizing its solenoid 73. As a result, the plunger 76 will be unseated to permit the communication of fluid pressure into the chamber 52. Such fluid pressure is effective in shifting the small piston 50 leftwardly against the force of the spring 54 until the stop members 55 cooperatively engage to stop further movement thereof so as to position the small piston at a predetermined longitudinal position within the bore. It will be appreciated that the relative differential sizes of the pistons 49 and 50 prevent the small piston from displacing the large piston from the shoulder 48. As a result of the movement of the small piston 50, the control rod 56 is also moved leftwardly causing the butterfly valves 34 and 35 to also moved leftwardly causing the butterfly valves 34 and 35 to be rotated in a clockwise direction, as viewed in the drawings, to a second or intermediate exhaust gas recirculation position. At such second position, the valve mechanism is effective in providing approximately 15 to 20 percent exhaust gas recirculation.

Figure 4:
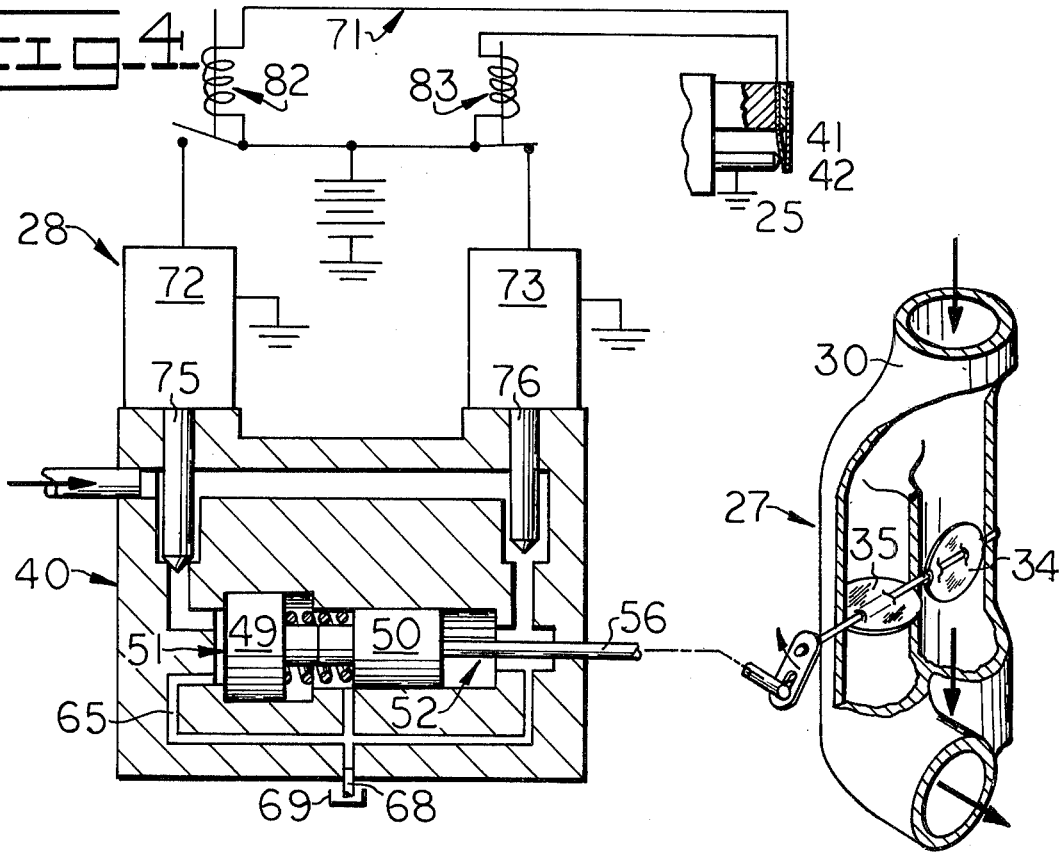

When the engine reaches approximately 80 percent of its rated load, the rod 25 will move further outwardly so as to deflect the first spring switch 41 against the second spring switch 42 so that the circuits to both of the relay switches 82 and 83 are completed. As best shown in FIG. 4, this casues the de-energization of the solenoid 72 which permits plunger 75 to seat so as to block further fluid communication to chamber 51. Thus, any fluid therein is permitted to exhaust through the drain passage 65 and conduit 68 to the reservoir 69. This allows the fluid pressure in chamber 52 to urge both of the pistons 49 and 50 further leftwardly until the large piston 49 engages the end of the bore. Consequently, the control rod 56 is moved further in a leftward direction, causing the further clockwise rotation of the butterfly valves 34 and 35 to a third or minimum exhaust gas recirculation position. At such third position, the valve mechanism is effective in permitting substantially no exhaust gas recirculation.

As the particular size, the amount of angular movement and the like of each of the butterfly valves 34 and 35 is dependent upon many variables, such as the particular diesel engine being used, the relative sizes of the exhaust and return passages, and the particular amounts of exhaust gas recirculation desired, it will be appreciated that the present invention is not intended to be limited by those shown and described herein. In general, the butterfly valve 34 is preferably sized only large enough relative to the exhaust passage so as to create a sufficient amount of back pressure in the exhaust system to cause the desired amount of exhaust gas to flow to the intake system, as any undue restriction will hinder operating efficiency of the engine. Such back pressure, in effect, replaces the vacuum used to draw the exhaust gas into the intake of a spark ignition engine.

The butterfly valve 35, in turn, is preferably sized to tightly close off the return passage when in its fully closed position so that no exhaust gas recirculation is permitted.

Thus, as is readily apparent from the foregoing, the present exhaust gas recirculation system 10 is effective in selectively providing varying amounts of exhaust gas recirculation through the engine in response to varying operating load conditions on the engine so as to reduce the emissions of oxides of nitrogen from such engine.

While the present invention has been described and shown with particular reference to the preferred embodiment, it will be apparent that variations might be possible that would fall within the scope of the present invention, which is not intended to be limited except as defined in the following claims.

What is claimed is:

1. An exhaust gas recirculating system for a diesel engine having an intake manifold and an exhaust manifold, said system comprising:

conduit means connected to the exhaust manifold and having a first passage for conducting exhaust gas from the exhaust manifold to the atmosphere and a second passage for conducting exhuast gas from the exhaust manifold to the intake manifold;

first and second valve means including first and second butterfly valves disposed within said first and second passages respectively; and control means responsive to engine load and operatively connected to said butterfly valves for regulating the recirculation of exhaust gas in relation to said load and including means for interconnecting said butterfly valves in opposite working relationship to effect the closing of the first butterfly valve while the second butterfly valve is being opened, said interconnecting means having a common shaft rotatably carried by said conduit means in transversely extending relation through said first and second passages thereof, and with said butterfly valves being fixedly mounted in predetermined angular relation to one another on said shaft within their respective passages.

2. The exhaust gas system of claim 1 wherein said control means includes motor means for rotating said shaft so as to position said first butterfly valve between a predetermined minimum flow restricting position and a maximum flow restricting position while simultaneously positioning said second butterfly valve between fully closed and fully opened positions, respectively.

3. The exhaust gas recirculation system of claim 2 in which the diesel engine includes a fuel system which is variably positionable to any of a plurality of different fuel supply settings in response to engine load and wherein said control means includes:

electrical control circuit means operative to sense at least three predetermined fuel setting positions of said fuel system; and said motor means is operatively controlled by said control circuit means for rotating said shaft such that said first and second butterfly valves are disposed in their maximum flow restricting position and fully open position, respectively, when the fuel system is at the first of said three predetermined fuel setting positions to provide a maximum amount of exhaust gas recirculation as said first position, said valves are disposed in a respective intermediate position when at the second of said fuel setting positions to provide an intermediate amount of exhaust gas recirculation thereat, and are in their respective minimum flow restricting, fully closed position when at the third of said fuel setting positions to provide a minimum amount of exhaust gas recirculation thereat.

4. The exhaust gas recirculation system of claim 3 wherein said maximum amount of exhaust gas recirculation is approximately 30 to 40 percent of the intake air into the engine, said intermediate amount of exhaust gas recirculation is approximately 15 to 20 percent, and said minimum amount of exhaust gas recirculation is substantially zero.

5. The exhaust gas recirculation system of claim 4 wherein said motor means includes:

a double piston hydraulic actuator comprising a housing having a stepped bore therein providing a large diameter end and an opposite small diameter end, a large piston and a small piston individually slidably mounted within their respective large and small ends of said bore and defining therewith a pair of fluid chambers at the opposite ends of said bore;

a control rod carried by said small piston and extending through said housing; and lever means carried by said shaft of the valve means and pivotally connected to said control rod for effecting the rotation of said butterfly valves upon axial movement of said small piston.

6. The exhaust gas recirculation system of claim 5 wherein said motor means further includes:

means for individually communicating fluid pressure to each of said fluid chambers; and a pair of solenoids individually controlled by said circuit means and each having a plunger operative to selectively block said fluid pressure to a respective one of said chambers so as to selectively position the small piston at predetermined positions along said bore corresponding to said predetermined fuel setting positions of the fuel system.

* * * * *